US009371645B1

(12) United States Patent
Harkins

(10) Patent No.: US 9,371,645 B1
(45) Date of Patent: Jun. 21, 2016

(54) WALL BAFFLE SYSTEM

(71) Applicant: Casey D. Harkins, Stoughton, WI (US)

(72) Inventor: Casey D. Harkins, Stoughton, WI (US)

( * ) Notice: Subject to any disclaimer, the term of this patent is extended or adjusted under 35 U.S.C. 154(b) by 0 days.

(21) Appl. No.: 14/943,054

(22) Filed: Nov. 17, 2015

(51) Int. Cl.

| | |
|---|---|
| ***E04B 2/20*** | (2006.01) |
| ***E04B 1/76*** | (2006.01) |
| ***E04B 2/16*** | (2006.01) |
| ***E04B 2/26*** | (2006.01) |
| ***E04C 1/40*** | (2006.01) |
| *E04B 1/74* | (2006.01) |

(52) U.S. Cl.
CPC ..... *E04B 2/20* (2013.01); *E04B 1/7604* (2013.01); *E04B 1/7612* (2013.01); *E04B 2/16* (2013.01); *E04B 2/26* (2013.01); *E04C 1/40* (2013.01); *E04B 2001/742* (2013.01); *E04B 2001/7679* (2013.01); *E04B 2001/7691* (2013.01)

(58) Field of Classification Search
CPC .... E04F 13/12; E04B 2/06; E04B 2001/7676; E04B 2001/7691; E04B 2/20; E04B 2001/2481; E04B 1/24; E04B 2/58; E04B 1/80; E04B 1/08; E04C 2/292
See application file for complete search history.

(56) References Cited

U.S. PATENT DOCUMENTS

| | | | | |
|---|---|---|---|---|
| 4,104,840 | A * | 8/1978 | Heintz | E04C 2/292 52/309.9 |
| 4,346,543 | A * | 8/1982 | Wilson | E04D 3/3602 52/404.2 |
| 6,754,997 | B2 * | 6/2004 | Bonin | E04C 2/521 52/198 |
| 8,407,957 | B2 * | 4/2013 | McClure | E04F 13/081 52/404.1 |
| 8,826,620 | B2 * | 9/2014 | Krause | E04F 13/0817 52/235 |
| 8,833,025 | B2 * | 9/2014 | Krause | E04F 13/0828 52/235 |
| 9,027,304 | B2 * | 5/2015 | McClure | E04F 13/0823 52/404.1 |
| 2009/0151286 | A1 * | 6/2009 | Stensrud | E04H 5/10 52/404.1 |
| 2012/0227342 | A1 * | 9/2012 | McClure | E04F 13/081 52/309.4 |
| 2013/0152498 | A1 * | 6/2013 | Krause | E04F 13/0828 52/235 |
| 2013/0340369 | A1 * | 12/2013 | McClure | E04F 13/081 52/309.4 |
| 2014/0083037 | A1 * | 3/2014 | McClure | E04C 2/46 52/404.1 |
| 2014/0102026 | A1 * | 4/2014 | McClure | E04F 13/0823 52/404.3 |
| 2014/0137497 | A1 * | 5/2014 | Bahnmiller | B32B 5/14 52/309.4 |
| 2015/0121787 | A1 * | 5/2015 | Krause | E04F 13/0817 52/302.1 |

* cited by examiner

*Primary Examiner* — Andrew J Triggs
(74) *Attorney, Agent, or Firm* — Donald J. Ersler

(57) ABSTRACT

A wall baffle system preferably includes a plurality of girt insulation blocks and a plurality of reflective insulation panels. Each girt insulation block preferably includes a contoured bottom surface, a girt cavity and a retention projection. Each reflective insulation panel includes a foil heat reflective strip and an insulation block. The foil heat reflective strip is affixed to a top or bottom of each insulation block. The girt insulation block is installed under each horizontal girt along a height of the outer wall. The plurality of reflective insulation panels are placed between a floor girt and a bottom of a girt insulation block; between a top of a horizontal girt and a bottom of a girt insulation block; or a top of a horizontal girt and a bottom of an eave girt insulation block.

20 Claims, 8 Drawing Sheets

108
12
115
100
104
102
HEAT
106
10
10
18
115
107
104
106
20
115
16
14
110
102
HEAT

112

114

108
100
32
115
35
HEAT
102
106
30
38
30
107
115
40
104
36
115
34
110
102
HEAT

112

114

108
52
115
115
55
HEAT
HEAT
102
50
58
60
56
107
115
115
54
HEAT
HEAT
110

50
115
104
102
112

114

100
108
12
115
102
102
10
106
HEAT
106
10
24
110
24
14
115
22
22
26
26
106
HEAT
10
116
103

114

100
108
32
35
HEAT
115
102
106
30
110
44
42
115
46
34
106
42
46
HEAT
30
44
113

114

100
108
52
55
115
HEAT
HEAT
102
106
106
50
110
62
50
66
62
115
64
54
66
106
50
HEAT
HEAT
64
123

114

WALL BAFFLE SYSTEM

BACKGROUND OF THE INVENTION

1. Field of the Invention

The present invention relates generally to energy efficient buildings and more specifically to a wall baffle system, which decreases the amount of heat loss through a vertical wall of a building.

2. Discussion of the Prior Art

Porous types of insulation such as fiberglass and mineral wool insulation have a problem of degraded performance in wall cavities and partially vertical wall and roof cavities. Heat rises in gasses and in liquids due to heat energy exciting the molecules in the matter, which causes the matter to expand and become less dense in the molecules above the source of heat. This lower density causes the gasses and liquids with the higher heat energy to rise as the cooler, denser molecules fall downward due to the effects of gravity and the less dense, more buoyant molecules rising to the top of gases and liquids. Like a hot air balloon, adding more heat into it decreases the density of the gases inside the hot air balloon. Once the gravitational force holding the balloon down is offset by the forces of the encapsulated lower density gasses rising upward in the cooler, denser air outside the balloon, the balloon rises in the opposite direction of the gravitational forces.

This same effect takes place inside of wall and roof cavities in air permeable insulation materials such as fiber glass and mineral wool insulation. While these materials generally have the most economic thermal insulation costs, the angle at which they are installed affects the performance of such assemblies. If one tests the performance with heat flow in the same downward direction as gravitational forces, you will get the highest resistance value as the natural heat direction is upward, opposite that of the natural flow of heat rising due the gravitational forces at work. The thermal resistance performance would be the optimum it could be.

If one tests the performance with the heat flow opposite the force of gravity, upward and in the same direction as the natural flow of heat, more heat will flow through the porous material as there is less resistance, because the heat is rising parallel with the natural flow of the heat upward. This will perform slightly less than the first example because the heat flow is faster when it flows in the same direction, as it's natural direction, so it has less resistance to flow. The heat simply does not have to fight the natural flow of heat in the same direction; so more heat would pass through the porous material in such an assembly.

If one tests the heat flow through porous materials in a horizontal direction, such as through a vertical wall, the performance can degrade significantly more. The reason for this added loss of performance is that the heat exposed to one side of a test sample assembly representing a vertical wall attempts to move to the point of lower energy on the cold side of the test specimen. This is the natural tendency of energy attempting to reach a point of equilibrium with all lower points of energy around it. There is a gradient that forms which follows the path of the energy from higher to lower energy. The path of this energy gradient varies significantly in porous insulation materials because the heat flow is improperly assumed to be generally linear from the closest points between the hot and the cold surfaces. This is simply a wrong assumption. What actually happens is that when the heat energy passes horizontally through the warm side air barrier of a porous insulation materials assembly, the heat energy immediately turns upward opposite the forces of gravity, rises and adds to the heat volume, which passed through the test sample air barrier directly above the first and lowest area unit of a heat entrance, and so on. This additive effect, like adding heat into a hot air balloon, is the same natural tendency of the heat energy to rise in gasses and liquids due to density changes caused by the added energy. The cumulative forces of the additive units of heat entering from the warm surface increases with the uninterrupted height of the sample vertical wall assembly. So the heat rises inside of the air porous wall test assemblies and the cumulative additional heat energy increases as the force and speed of the heat flow inside the test wall sample rises upward through the porous insulation material, opposite the force of gravity. This differs from the horizontal sample that does not have the cumulative effect as each unit of surface area is generally independent of the each other, with the heat rising parallel and opposite with the gravitational forces downward.

The net effect of the heat flow through the vertical assembly with air porous insulation is that the force and speed of the heat flow increases over the vertical distance of uninterrupted flow. So the heat flow rate at the bottom of the test assembly would be the lowest and the heat flow rate at the top of the test sample would be the highest due to the natural flow of heat opposite the force of gravity in the air porous insulation. Although these heat directional forces may be small individually, it is the accumulation or additive effect that can reduce the overall thermal resistance performance of the assembly as is seen in hot box tests of these air porous insulation assemblies. Data collected inside the walls of actual buildings with porous insulation, fiberglass, confirm that there is up to 40 degrees temperature difference inside the wall from the bottom to the top of a 20 foot high metal building wall. Heat rises vertically inside the air porous insulation materials and assemblies. It must then be assumed that the rate of heat flow changes with the angle of the assembly from vertical, highest flow rate, to the horizontal, the lowest flow rate. This is due to the cumulative forces and the increased flow rate of the heat rising inside the vertical assembly containing the porous insulation material. The density of the porous insulation material will also have an effect on the rate of flow and the thermal performance resistance in a particular assembly.

Metal buildings generally have horizontal conductive, steel girts nominally every six feet apart vertically. To these girts are typically attached conductive metal panels of some type. Typically these conductive girts pass horizontally through the thickness of most of the insulation. The heat flow upward inside of these metal building walls encounters these highly conductive steel members which are typically colder than the inside building temperature in the heating season. Correspondingly, the girts would be hotter than the interior building temperatures in the cooling season and the heat flow would be in the opposite direction, outside to inside. The effect of these highly conductive steel girts is to absorb some of the energy accumulated and rising with increasing force and speed inside of the vertical, porous insulation wall assemblies. The girts quickly absorb and conduct the heat to the colder side where it is radiated into the cooler environment. Hot box tests of metal building indicate a 20% to 30% reduction in performance as compared to the horizontal testing of identical and similar assemblies. It is expected that the rate of heat flow increases with the uninterrupted height of the vertical wall assembly with the porous insulation material.

This loss of thermal performance of wall assemblies with porous insulation results in reduced thermal performances of these assemblies and higher energy costs.

There is a difficulty in meeting minimum energy code criteria set for these type of assemblies with porous insulation inside them, because the insulation thickness required exceeds the space available to achieve the very low rates of heat flow or high insulation resistance. Installations at angles to the vertical would also have a progressively decreasing effect from these additive effects of the heat; because the heat becomes less additive, the more the assembly is positioned horizontally.

So there is a need for structures and methods which block the additive effect of the energy rising in the vertical wall assemblies of buildings and also of angled assemblies of buildings to reduce the accelerated heat loss caused by the increase of the forces and of a rate of speed of the heat movement through these assemblies containing porous insulation materials. There is also a need to block the heat from contacting the conductive girts in the building walls, which readily absorb and conduct the heat energy to the colder environment. There is also a need to divert the path of the heat flow direction back toward the warm side using sloped diverters or baffles, which will result in less heat loss to the colder environment absent the diversions which create resistance. There is also a need to increase the effectiveness of the diversion means by making the surfaces energy reflective such as polished aluminum foil.

Installations at angles to the vertical would also have a progressively decreasing effect from these additive effects of the heat because the heat becomes less additive the more horizontal the assembly is positioned.

Accordingly, there is a clearly felt need in the art for a wall baffle system, which includes inserting a plurality of reflecting insulation panels between horizontal girts adjacent an outer wall and attaching thermal blocks to a bottom of horizontal girts to block the absorption of upward heat flow adjacent the outer wall to decrease the amount of heat loss through the outer wall of a building and to meet energy code criteria within the existing thickness space inside these building walls.

SUMMARY OF THE INVENTION

The present invention provides a wall baffle system, which decreases the amount of heat loss through a vertical wall of a building. The wall baffle system preferably includes a plurality of girt insulation blocks and a plurality of reflective insulation panels. Each girt insulation block preferably includes a downward sloping bottom surface, a girt cavity and a retention projection. The downward sloping bottom surface is the highest at the heated space, relative to a floor of the building and slopes downward toward the outer wall of the building where the heat energy loss is predominantly in the heating season. Where the building inside is predominantly cooled, the slope would be reversed to deflect and reflect heat energy back to toward the exterior warmer surface and would be within the intended scope of this invention. The downward sloping bottom surface preferably has an angle of between 0 to 80 degrees. The girt cavity is sized to receive a downward extending portion of the girt. The girt cavity creates a wall portion in the girt insulation block. The retention projection extends inward from a top of the wall portion.

Each reflective insulation panel includes a foil heat reflective strip and an insulation block. The foil heat reflective strip affixed to at least one of a bottom and a top of each insulation block. Each base (bottom) reflective insulation panel is preferably crushed on a surface adjacent to the outer wall surface of a wall insulation cavity of a building to create a resulting sloped surface, which mates with the downward sloping bottom surface of the girt insulation block. Reflective insulation panels placed on top of the base reflective panel will take on a trapezoidal cross section and will not need to be crushed to create the sloped reflective surface. However, other methods of creating a downward slope on a bottom or a top of the reflective insulation panel may also be used.

The slope results in heat energy rising and directed up the slope towards the inner heated space and also heat energy may be reflected back toward the inner heated space, each of which will reduce the flow rate of heat to the outer surface of the building wall which adds to the overall resistance. The girt insulation blocks are installed under each row of horizontal girts along a height of the outer wall, including the eave girt which is sometimes also called the eave purlin or eave strut. An eave girt insulation block includes a downward sloping bottom surface toward the outer wall, but does not include the retention projection of the typical girt insulation block due to the absence of the typical girt bottom projecting girt flange. The plurality of girt insulation blocks and the eave girt insulation blocks are preferably attached to the girts with double sided tape or adhesive. The plurality of girt and eave girt insulation blocks extend an entire length of each wall in a building. The plurality of reflective insulation panels are placed between a floor girt and a bottom of a girt insulation block; between a top of a horizontal girt and a bottom of a girt insulation block; or a top of a horizontal girt and a bottom of an eave girt insulation block. Preferably, the reflective insulation panels could be adhered to the bottom sloped surfaces of the girt insulation blocks with a reflective surface facing down and toward the warmer surface. Some of the heat traveling through a wall of the heated space toward the outer colder wall of the building will turn to an upward, vertical direction, but will be reflected back toward the heated space by the plurality of reflective foil strips. The girt and eave girt insulation blocks prevent heat from being absorbed by the girts and quickly conducting the heat to the outer wall of the building and lost to the cold exterior atmosphere.

Accordingly, it is an object of the present invention to provide a wall baffle system, which includes attaching thermal blocks to a bottom of horizontal girts to block the joining or accumulation of upward heat flow adjacent the outer wall to decrease the amount of heat loss through the outer wall of a building, or inserting a plurality of inward reflecting insulation panels between horizontal girts adjacent an outer wall, or both of the above. For buildings, which are predominantly cooled, the sloped would be reversed to divert and reflect heat back to the warmer, exterior side of the wall.

These and additional objects, advantages, features and benefits of the present invention will become apparent from the following specification.

DETAILED DESCRIPTION OF THE PREFERRED EMBODIMENTS

Figures 1, 2:
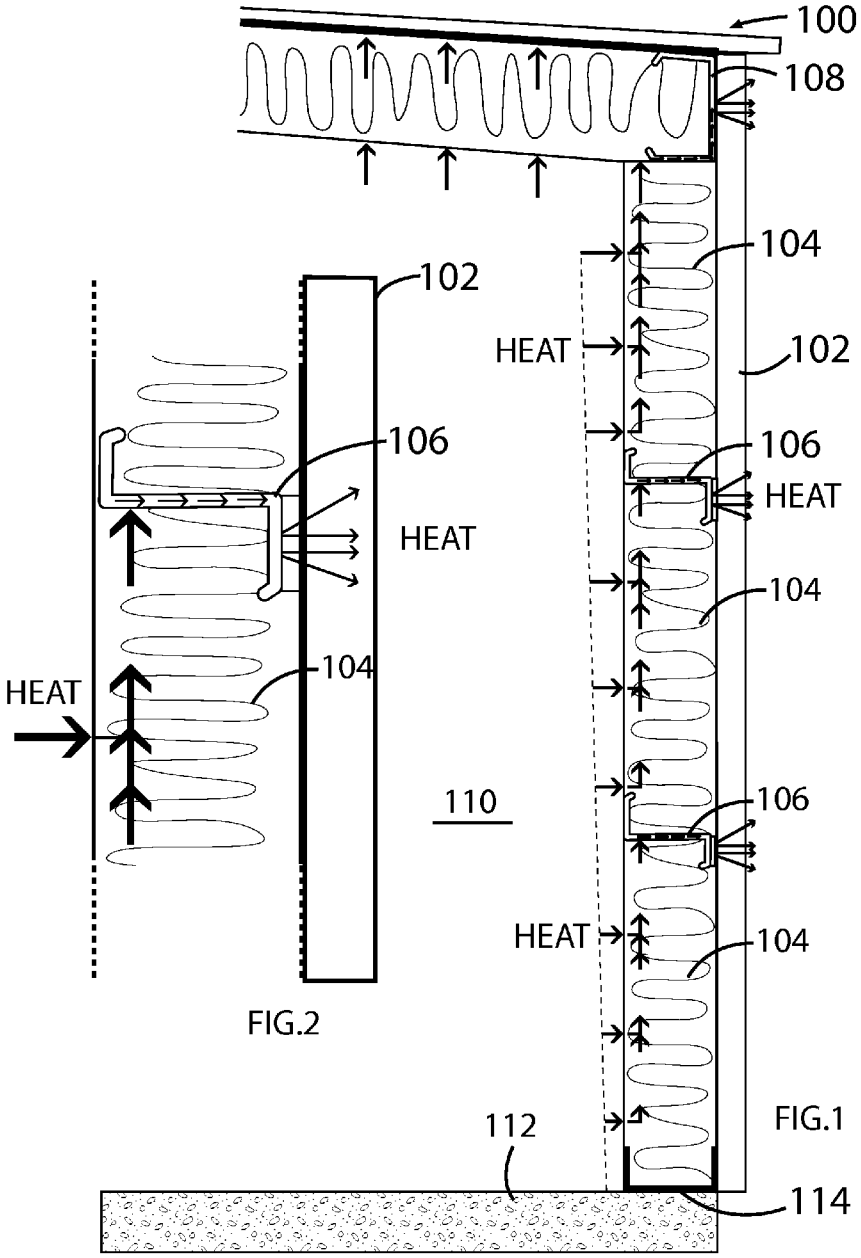
FIG. 1 is a partial cross sectional side view of a metal building illustrating the problem of heat rising through insulation and exiting through wall girts and eave girts.
FIG. 2 is an enlarged cross sectional side view of an area adjacent a purlin of an outer wall of a metal building illustrating the problem of heat rising through insulation and exiting through girts and eave girts.
Figures 3, 4:
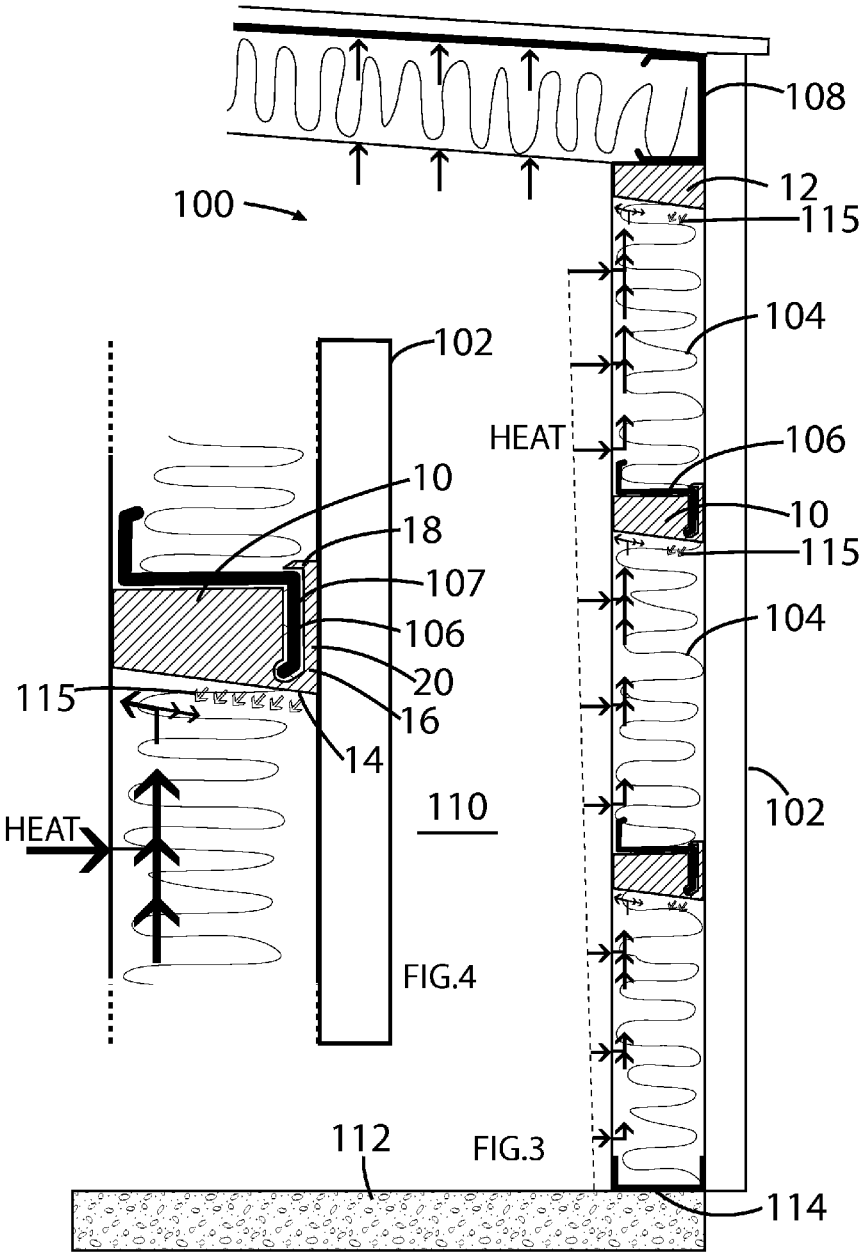
FIG. 3 is a partial cross sectional side view of a metal building illustrating heat rising through insulation and being deflected back into a heated space by a plurality of girt insulation blocks of a wall baffle system in accordance with the present invention.
FIG. 4 is an enlarged cross sectional side view of an adjacent girt of an outer wall of a metal building illustrating heat rising through insulation and being deflected back into a heated space by a plurality of girt insulation blocks of a wall baffle system in accordance with the present invention.
Figures 3A, 4A:
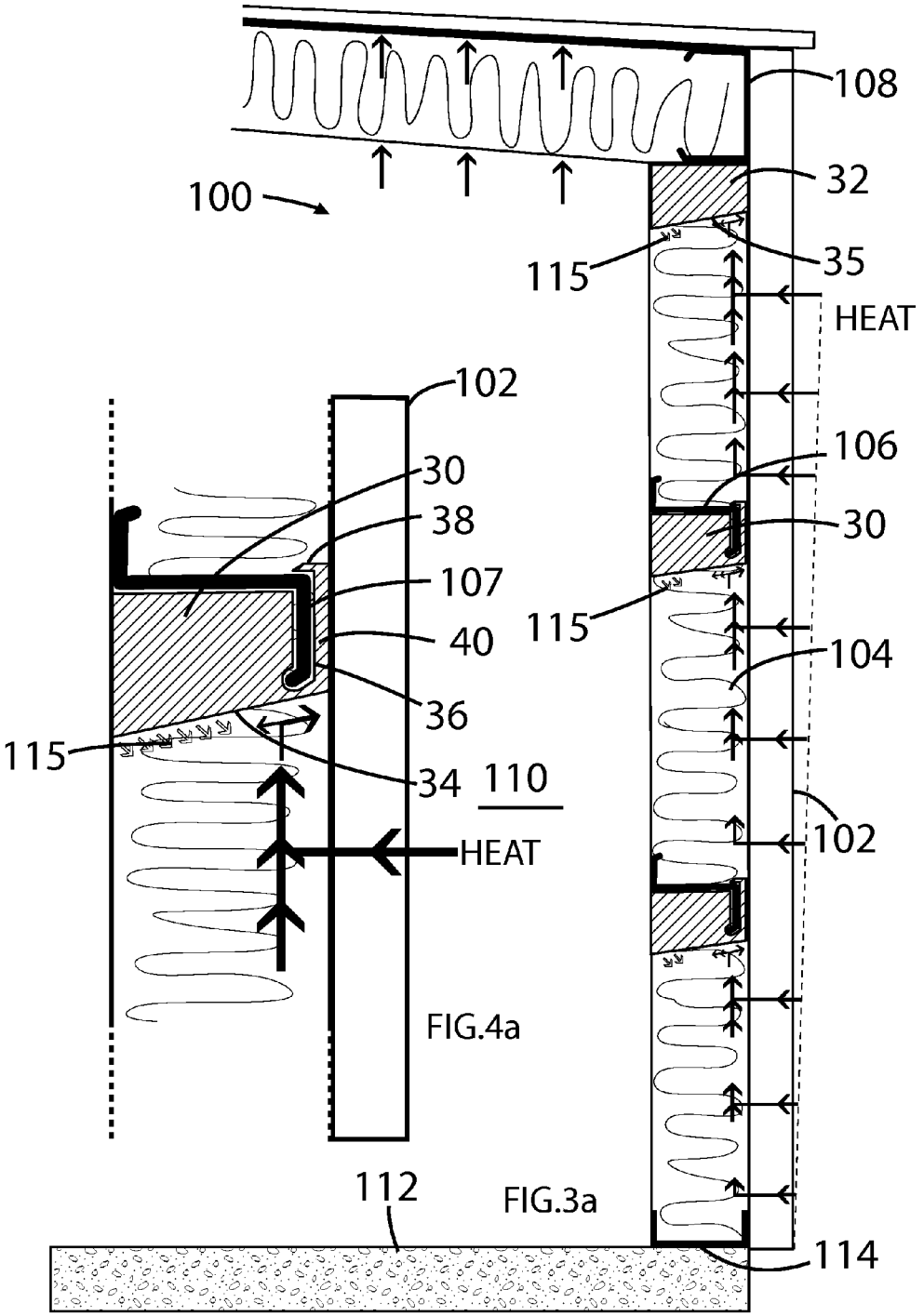
FIG. 3*a* is a partial cross sectional side view of a metal building illustrating external heat rising through insulation and being deflected back outward toward a hot exterior atmosphere by a plurality of reverse slope insulation blocks of a wall baffle system when the interior building space is cooled in accordance with the present invention.
FIG. 4*a* is an enlarged cross sectional side view of an adjacent girt of an outer wall of a metal building illustrating heat rising through insulation and being diverted and deflected back outward to a warmer exterior atmosphere by a plurality of girt reverse slope insulation blocks of a wall baffle system in accordance with the present invention.
Figures 3B, 4B:
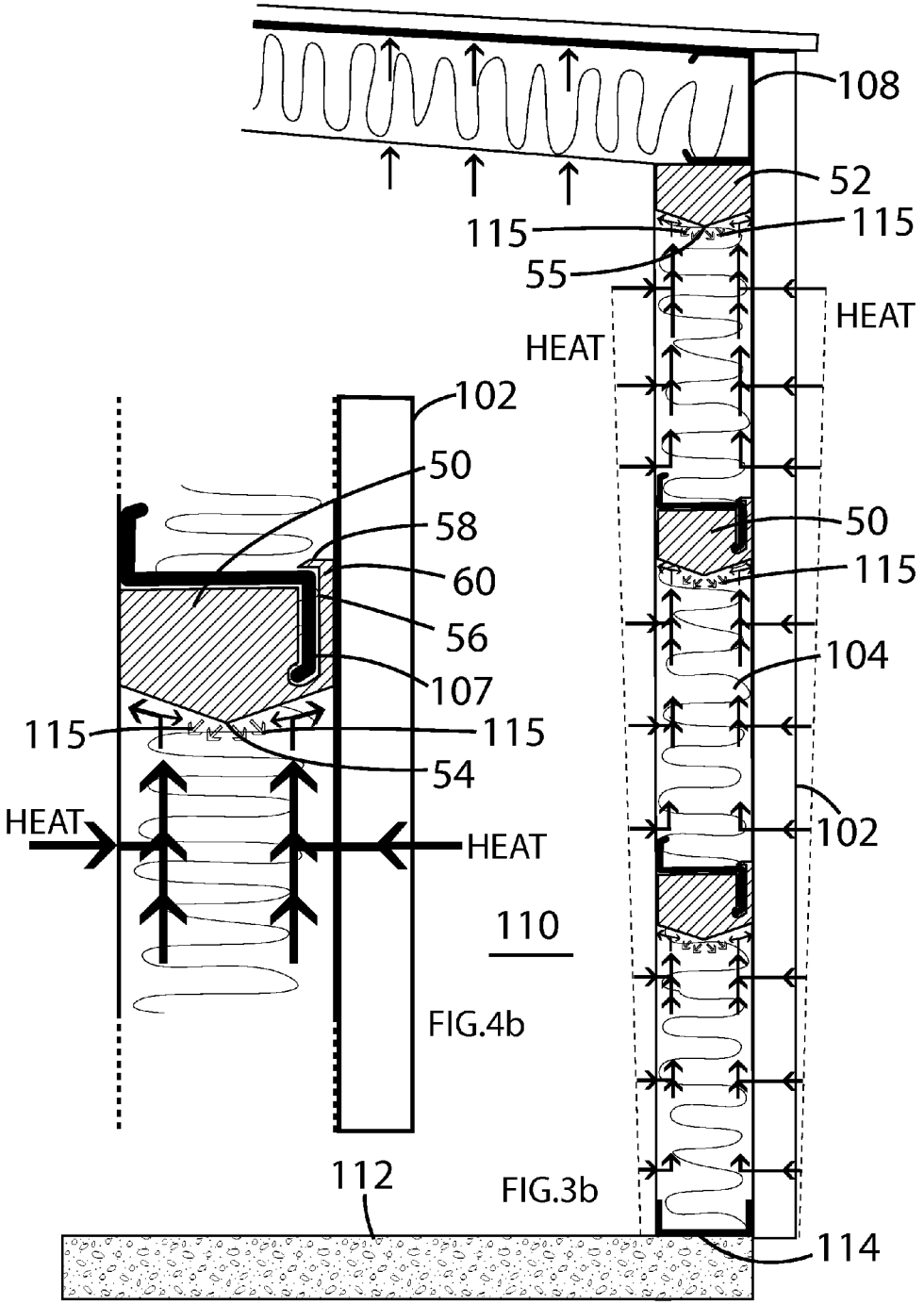
FIG. 3*b* is a partial cross sectional side view of a metal building illustrating heat rising through insulation and being deflected back toward a warmer surface by a plurality of double slope insulation blocks of a wall baffle system where the interior space is periodically heated or cooled. The double slope works in both applications to divert and reflect heat energy directionally toward a warmer surface using the double slope in accordance with the present invention.
FIG. 4*b* is an enlarged cross sectional side view of an adjacent girt of an outer wall of a metal building illustrating heat rising through insulation and being deflected back toward a heated space or an exterior warmer surface by a plurality of girt double slope insulation blocks of a wall baffle system in accordance with the present invention.

With reference to FIG. 1, a cross sectional side view of an outer wall 102 of a metal building 100 illustrating the problem of heat rising through insulation 104 and exiting through girts 106 and eave girts 108. The amount of heat escaping a heated inner space 110 grows the further a distance from a floor 112. FIG. 2 is an enlarged view of an area adjacent the girt 106 illustrating the loss of heat. With reference to FIGS. 3-4, a girt insulation block 10 is secured to a bottom of each girt 106 and an eave girt insulation block 12 is secured to a bottom of the eave girt 108. The girt and eave girt insulation blocks 10, 12 may be secured to the girt 106 and the eave girt 108 with double sided tape or the like. Each girt insulation block 10 preferably includes a downward sloping bottom surface 14, a girt cavity 16 and a retention projection 18. The downward sloping bottom surface 14 is the highest at the side of the heated inner space 110, relative to the floor 112 of the building 100 and slopes downward toward the outer wall 102 and the floor 112 of the building 100. The downward sloping bottom surface 14 preferably has an angle of between 0-80 degrees relative to a horizontal plane. The girt cavity 16 is sized to receive a downward extending portion 107 of the girt 106. The girt cavity 16 creates a wall portion 20 in the girt insulation block 10. The wall portion 20 is inserted between the girt 10 and the outer wall 102. The retention projection 18 extends inward from a top of the wall portion 20. The retention projection 18 retains the girt insulation block 10 on the girt 106.

The eave girt insulation block 12 includes a downward sloping bottom surface 15, but does not include the girt cavity 16 and the retention projection 18 of the girt insulation block 10. The plurality of girt insulation blocks 10 and the eave girt insulation blocks 12 are preferably attached to the girts 106, 108 with double sided tape. Deflected heat 115 is represented by a plurality of arrows. The deflected heat 115 reflects back into the heated space 110 from the downward sloping bottom surfaces 14, 15. The plurality of girt and eave girt insulation blocks 10, 12 extend an entire length of each wall in a building. The plurality of girt and eave girt insulation blocks 10, 12 are preferably fabricated from a non-porous material, such as closed cell foam.

With reference to FIGS. 3*a*-4*a*, a girt insulation block 30 is secured to a bottom of each girt 106 and an eave girt insulation block 32 is secured to a bottom of the eave girt 108. The girt and eave girt insulation blocks 30, 32 may be secured to the girt 106 and the eave girt 108 with double sided tape or the like. Each girt insulation block 30 preferably includes a reverse downward sloping bottom surface 34, a girt cavity 36 and a retention projection 38. The reverse downward sloping bottom surface 34 is the lowest at the side of the cooled inner space 110, relative to the floor 112 of the building 100 and slopes upward toward the outer wall 102 and the floor 112 of the building 100. The reverse downward sloping bottom surface 14 preferably has an angle of between 0-80 degrees with relative to a horizontal plane. The girt cavity 36 is sized to receive a downward extending portion 107 of the girt 106. The girt cavity 36 creates a wall portion 40 in the girt insulation block 30. The wall portion 40 is inserted between the girt 106 and the outer wall 102. The retention projection 38 extends inward from a top of the wall portion 20. The retention projection 38 retains the girt insulation block 30 on the girt 106.

The eave girt insulation block 32 includes a reverse downward sloping bottom surface 35, but does not include the girt cavity 36 and the retention projection 38 of the girt insulation block 40. The plurality of girt insulation blocks 30 and the eave girt insulation blocks 32 are preferably attached to the girts 106, 108 with double sided tape. The deflected heat 115 reflects back to outside the wall 102 from the downward sloping bottom surfaces 34, 35. The plurality of girt and eave girt insulation blocks 30, 32 extend an entire length of each wall in a building. The plurality of girt and eave girt insulation blocks 30, 32 are preferably fabricated from a non-porous material, such as closed cell foam.

With reference to FIGS. 3*b*-4*b*, a girt insulation block 50 is secured to a bottom of each girt 106 and an eave girt insulation block 52 is secured to a bottom of the eave girt 108. The girt and eave girt insulation blocks 50, 52 may be secured to the girt 106 and the eave girt 108 with double sided tape or the like. Each girt insulation block 50 preferably includes a V-shaped bottom surface 54, a girt cavity 56 and a retention projection 58. The V-shaped bottom surface 54 is the highest at each end and the lowest at a middle of the girt insulation block 50. First and second sloping bottom surfaces of the V-shaped bottom surface 54 preferably have an angle of between 1-80 degrees relative to a horizontal plane. The girt cavity 56 is sized to receive a downward extending portion 107 of the girt 106. The girt cavity 56 creates a wall portion 60 in the girt insulation block 50. The wall portion 60 is inserted between the girt 106 and the outer wall 102. The retention projection 58 extends inward from a top of the wall portion 60. The retention projection 58 retains the girt insulation block 50 on the girt 106.

The eave girt insulation block 52 includes a V-shaped bottom surface 55, but does not include the girt cavity 56 and the retention projection 58 of the girt insulation block 60. The plurality of girt insulation blocks 50 and the eave girt insulation blocks 52 are preferably attached to the girts 106, 108 with double sided tape. The deflected heat 115 reflects back into the heated space 110 or to outside the wall 102 from the V-shaped bottom surfaces 54, 55. The plurality of girt and eave girt insulation blocks 50, 52 extend an entire length of each wall in a building. The plurality of girt and eave girt insulation blocks 50, 52 are preferably fabricated from a non-porous material, such as closed cell foam.

Figures 5, 6:
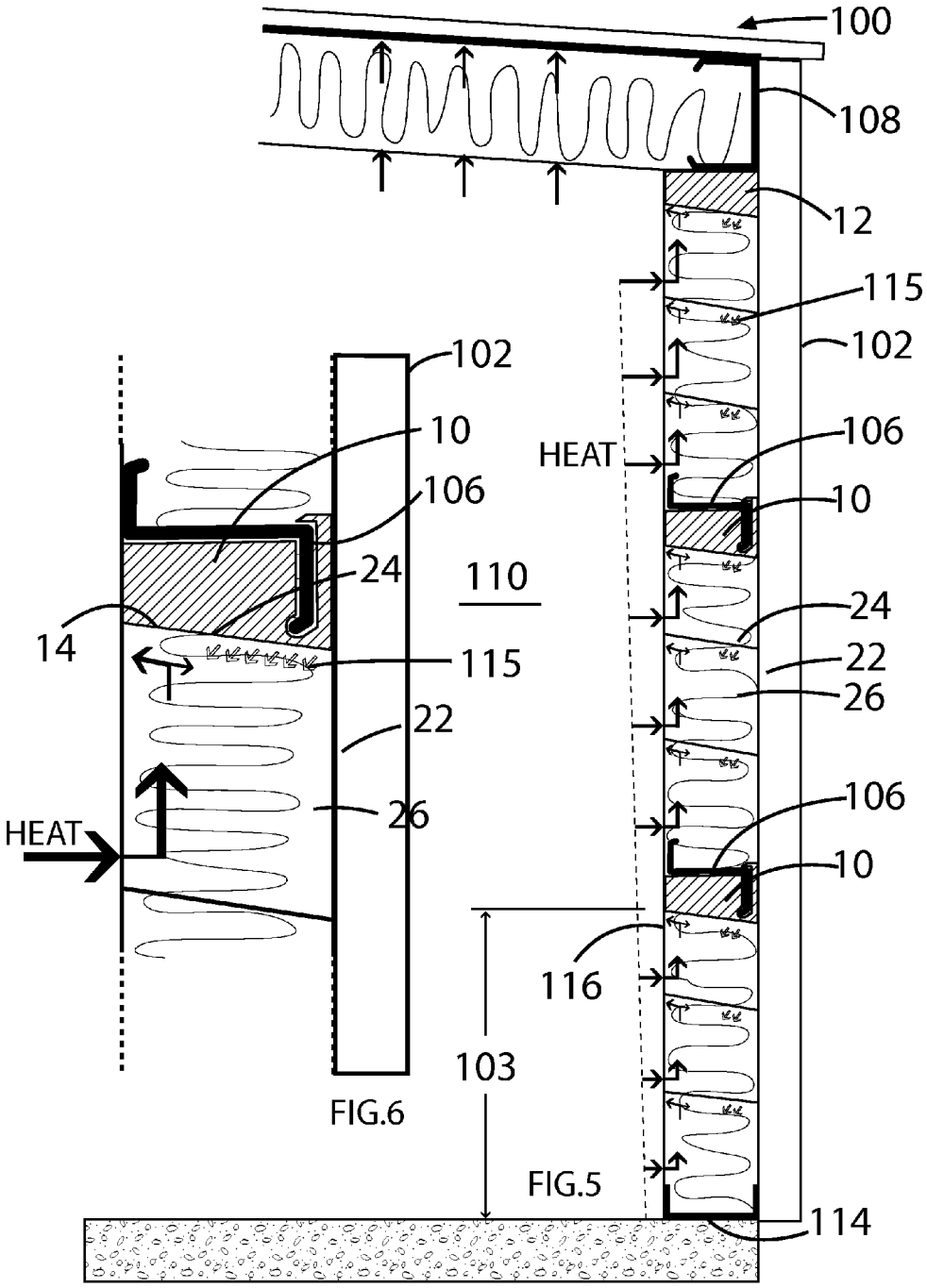
FIG. 5 is a partial cross sectional side view of a metal building illustrating heat rising through insulation and being deflected back into a heated space by a plurality of girt insulation blocks and a plurality of reflective insulation panels of a wall baffle system in accordance with the present invention.
FIG. 6 is an enlarged cross sectional side view of an adjacent a girt of an outer wall of a metal building illustrating heat rising through insulation and being deflected back into a heated space by a plurality of girt insulation blocks and a plurality of reflective insulation panels of a wall baffle system in accordance with the present invention.
Figures 5A, 6A:
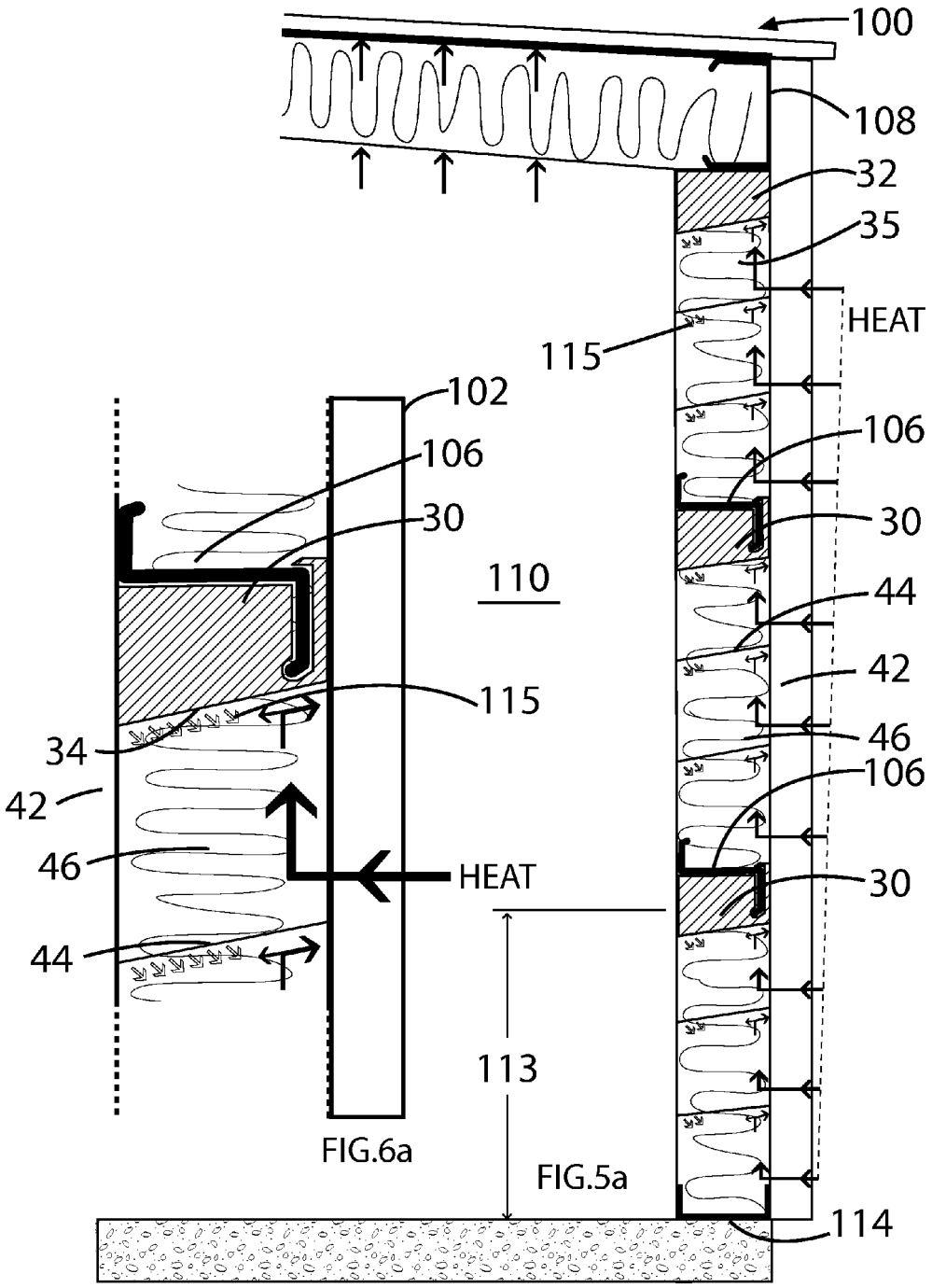
FIG. 5*a* is a partial cross sectional side view of a metal building illustrating heat rising through insulation and being deflected back toward a warmer surface by a plurality of girt reverse slope insulation blocks and a plurality of reverse slope reflective insulation panels of a wall baffle system in accordance with the present invention.
FIG. 6*a* is an enlarged cross sectional side view of an adjacent a girt of an outer wall of a metal building illustrating heat rising through insulation and being deflected toward a hotter surface by a plurality of girt reverse slope insulation blocks and a plurality of reflective reverse slope insulation panels of a wall baffle system in accordance with the present invention.
Figures 5B, 6B:
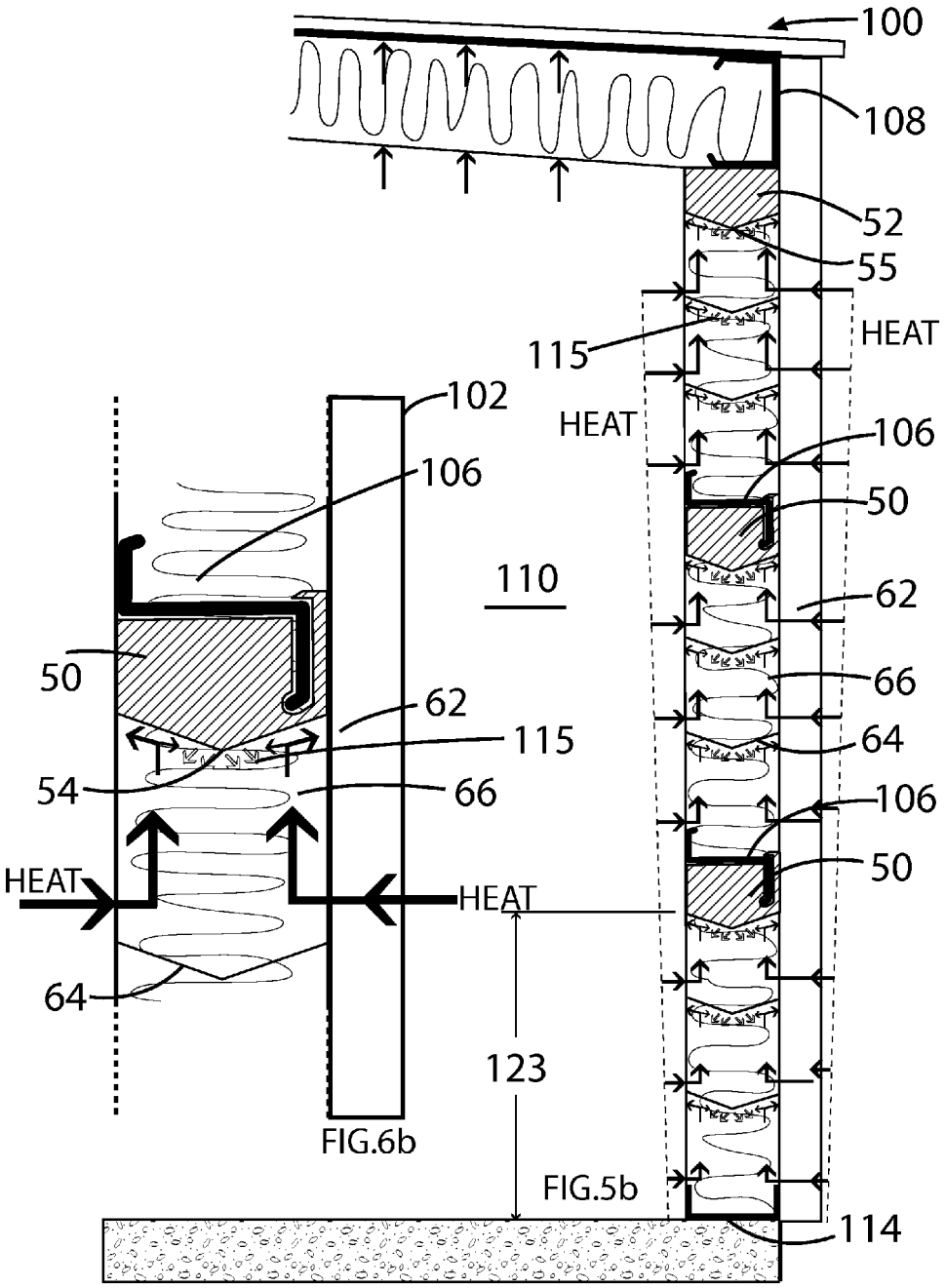
FIG. 5*b* is a partial cross sectional side view of a metal building illustrating heat rising through insulation and being deflected back toward a heated space or an exterior warmer surface by a plurality of girt double slope insulation blocks and a plurality of double slope reflective insulation panels of a wall baffle system in accordance with the present invention.
FIG. 6*b* is an enlarged cross sectional side view of an adjacent a girt of an outer wall of a metal building illustrating heat rising through insulation and being deflected back toward a heated space or an exterior warmer surface by a plurality of girt double slope insulation blocks and a plurality of reflective double slope insulation panels of a wall baffle system in accordance with the present invention.

With reference to FIGS. 5-6, a plurality of reflective insulation panels 22 are inserted between a floor girt 114 and a bottom of a girt insulation block 10; between a top of the girt 106 and a bottom of a girt insulation block 10; and a top of the girt 106 and a bottom of an eave girt insulation block 12. Each reflective insulation panel 22 includes a foil reflective strip 24 and an insulation block 26. The foil reflective strip 24 is affixed to either a bottom or a top of each insulation block 26. The foil reflective strip 24 may also be located on a bottom of the girt insulation block 10 and the eave girt insulation block 12. The deflected heat 115 reflects back into the heated space 110 from the foil reflective strip 24.

With reference to FIGS. 5*a*-6*a*, a plurality of reflective insulation panels 42 are inserted between a floor girt 114 and a bottom of a girt insulation block 30; between a top of the girt 106 and a bottom of a girt insulation block 30; and a top of the girt 106 and a bottom of an eave girt insulation block 32. Each reflective insulation panel 42 includes a foil reflective strip 44 and an insulation block 46. The foil reflective strip 44 is affixed to either a bottom or a top of each insulation block 46. The foil reflective strip 44 may also be located on a bottom of the girt insulation block 30 and the eave girt insulation block 32. The deflected heat 115 reflects back to outside the wall 102 from the foil reflective strip 44.

Figure 7:
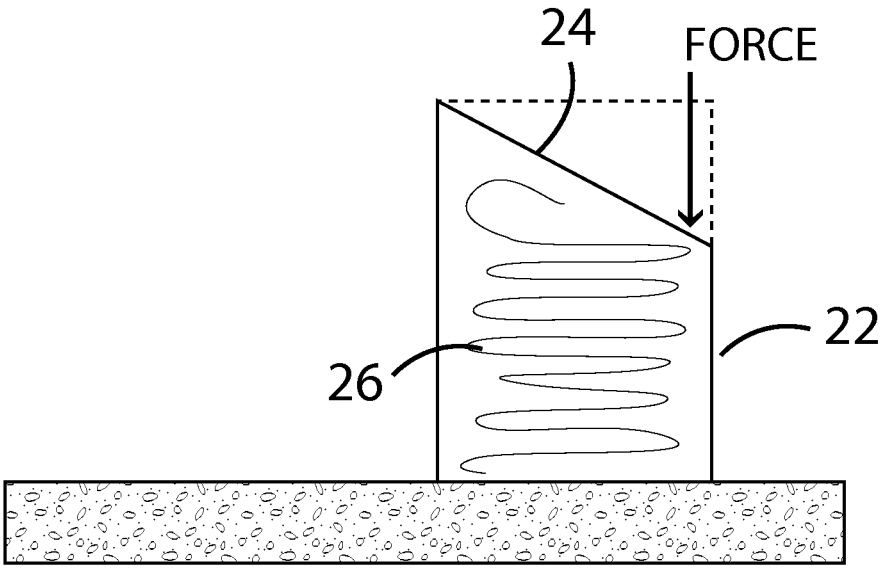
FIG. 7 is a side view of a reflective insulation panel being crushed to a slope of a wall baffle system in accordance with the present invention.

With reference to FIGS. 5*b*-6*b*, a plurality of reflective insulation panels 62 are inserted between a floor girt 114 and a bottom of a girt insulation block 50; between a top of the girt 106 and a bottom of a girt insulation block 50; and a top of the girt 106 and a bottom of an eave girt insulation block 52. Each reflective insulation panel 62 includes a foil reflective strip 64 and an insulation block 66. The foil reflective strip 64 is affixed to either a bottom or a top of each insulation block 66. The foil reflective strip 64 may also be located on a bottom of the girt insulation block 50 and the eave girt insulation block 52. The deflected heat 115 reflects back into the heated space 110 or to outside the wall 102 from foil reflective strip 64. With reference to FIG. 7, each base (bottom) reflective insulation panel 22 is preferably crushed on a surface adjacent to the outer wall 102 of a wall insulation cavity 103 of the building 100 to create a resulting sloped surface, which mates with the downward sloping bottom surface 14 of the girt insulation block 10. Reflective insulation panels 22 placed on top of the base reflective panel 22 will take on a trapezoidal cross section and will not need to be crushed to create the sloped foil reflective surface 24. However, other methods of creating a downward slope on a top of the reflective insulation panel 22 may also be used. The girt insulation block 10 is installed under each horizontal girt 106 along a height and length of the outer wall 102.

Some of the heat traveling through the insulation 104 toward the outer wall 102 of the building 100 will turn to a vertical direction, but will be reflected back toward the heated inner space 110 by the plurality of foil reflective strips 24. The girt and eave girt insulation blocks 10, 12 prevent heat from being absorbed from by the girts 106, 108 and the heat exiting the outer wall 102 of the building 100.

Each base (bottom) reflective insulation panel 42 is preferably crushed on a surface adjacent to the inner space 110 of a wall insulation cavity 113 of the building 100 to create a resulting reverse sloped surface, which mates with the downward sloping bottom surface 34 of the girt insulation block 30. Reflective insulation panels 42 placed on top of the base reflective panel 42 will take on a trapezoidal cross section and will not need to be crushed to create the sloped foil reflective surface 44. However, other methods of creating the reverse downward slope on a top of the reflective insulation panel 42 may also be used. The girt insulation block 42 is installed under each horizontal girt 106 along a height of the outer wall 102. The sloped foil reflective surface 44 prevents hot air from outside the wall 102 from entering a cooled inner space 110.

Each base (bottom) reflective insulation panel 62 is preferably crushed in a middle thereof to create the resulting V-shaped foil reflective strip 64. Foil reflective strips 64 of the reflective insulation panels 62 are placed on top of the base reflective insulation panel 62 and will take on the shape of the V-shaped foil reflective strip 64 of the base reflective insulation panel 62. However, other methods of creating the V-shaped foil reflective strip 64 may also be used. The girt insulation block 62 is installed under each horizontal girt 106 along a height of the outer wall 102. The V-shaped foil reflective surface 64 prevents hot air inside a heated inner space 110 from exiting through an outside wall 102, and hot air from outside the wall 102 from entering a cooled inner space 110.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A wall insulation system for a building having a plurality of conductive horizontal girts comprising:

a girt insulation block includes a substantially horizontal top surface and a sloped bottom surface, said sloped bottom surface extends substantially a width of one of the plurality of conductive horizontal girts, said girt insulation block is fabricated from a different material than the plurality of conductive horizontal girts, said girt insulation block includes a first thickness measured from said substantially horizontal top surface to said sloped bottom surface at a first end, a second thickness measured from said substantially horizontal top surface to said sloped bottom surface at a second end, and a middle thickness measured from said substantially horizontal top surface to said sloped bottom surface at a location between said first and second ends, said first end is adjacent to an inner space of the building, wherein said sloped bottom surface includes one of: said second thickness being greater in magnitude than said first thickness, said second thickness being greater in magnitude than said first thickness, and said middle thickness is greater in magnitude than said first and second thicknesses; said girt insulation block is positioned adjacent an underside of one of the plurality of conductive horizontal girts.

2. The wall insulation system for a building having a plurality of conductive horizontal girts of claim 1 wherein:

said girt insulation block includes a girt cavity formed in a top thereof, said girt cavity is sized to receive a downward extending portion of one of the plurality of wall girts.

3. The wall insulation system for a building having a plurality of conductive horizontal girts of claim 2 wherein:

said girt cavity creates a wall portion in said girt insulation block, wherein said wall portion is inserted between one of the plurality of girts and the outer wall.

4. The wall insulation system for a building having a plurality of conductive horizontal girts of claim 1, further comprising:

an eave girt insulation block includes a sloped bottom surface and a top surface, a thickness of said eave girt insulation block is measured from said bottom surface to said top surface, wherein said sloped bottom surface is one of: least thick at a side of an inner space and slopes downward toward an outer wall of a building, least thick adjacent the outer wall and slopes downward toward the inner space of the building, and thickest at a point located between the inner space and the outer wall of the building and slopes upward partially toward both the inner space and partially toward the outer wall of the building.

5. The wall insulation system for a building having a plurality of conductive horizontal girts of claim 4 wherein:

said plurality of girt and eave girt insulation blocks are fabricated from a non-porous material.

6. The wall insulation system for a building having a plurality of conductive horizontal girts of claim 1 wherein:

said slope has an angle of 0-80 degrees relative to a horizontal plane.

7. The wall insulation system for a building having a plurality of conductive horizontal girts of claim 1, further comprising:

a heat diverting surface located on said sloped bottom surface.

8. A wall insulation system for a building having a plurality of horizontal girts comprising:

an insulation panel that includes a porous insulation block and a heat diverting surface, said heat diverting surface is located on one of: a bottom surface and a top surface of said porous insulation block; said porous insulation block and said heat diverting surface extend substantially a width of one of the plurality of horizontal girts, said porous insulation block includes a thickness measured from said top surface to said bottom surface, wherein at least one of said top surface and said bottom surface of said porous insulation block is sloped by one of: having a least thickness at a side of an inner space and sloping downward toward an outer wall of a building, having a least thickness adjacent the outer wall and sloping downward toward the inner space of the building, and having a V-shape which extends a width of said porous insulation block; wherein said of insulation panel is inserted between two adjacent horizontal girts of a building, wherein the two adjacent horizontal girts are at least one of: an eave girt, a wall girt, a floor girt and a base girt.

9. The wall insulation system for a building having a plurality of horizontal girts of claim 8 wherein:

at least one said insulation panel extends substantially an entire length of each outer wall in the building.

10. The wall insulation system for a building having a plurality of horizontal girts of claim 8 wherein:

said slope has an angle of 0-80 degrees relative to a horizontal plane.

11. A wall insulation system for a building having a plurality of horizontal girts comprising:

a girt insulation block that includes a sloped bottom surface and a top surface, a thickness of said girt insulation block is measured from said bottom surface to said top surface, wherein said sloped bottom surface is one of: least thick at a side of an inner space and slopes downward toward an outer wall of a building, least thick adjacent the outer wall and slopes downward toward the inner space of the building, and a V-shape which extends a width of said porous insulation block; a plurality of said girt insulation blocks are secured to a plurality of wall girts in the building, said girt insulation block is positioned adjacent an underside of one of the plurality of conductive horizontal girts; and an insulation panel includes a porous insulation block and a heat diverting surface, said heat diverting surface is located on one of a bottom surface and a top surface of said porous insulation block, said porous insulation block and said heat diverting surface extend substantially a width of one of the plurality of horizontal girts, wherein said insulation panel is inserted under said girt insulation block, a top of said insulation panel is sloped to mate with said sloped bottomed surface of said girt insulation block, wherein said porous insulation panel is inserted between two adjacent girts of a building, wherein the two adjacent girts are at least one of: an eave girt, a wall girt, a floor girt, a base girt.

12. The wall insulation system for a building having a plurality of horizontal girts of claim 11 wherein:

said girt insulation block includes a girt cavity formed in a top thereof, said girt cavity is sized to receive a downward extending portion of one of the plurality of wall girts.

13. The wall insulation system for a building having a plurality of horizontal girts of claim 12 wherein:

said girt cavity creates a wall portion in said girt insulation block, wherein said wall portion is inserted between one of the plurality of girts and the outer wall.

14. The wall insulation system for a building having a plurality of horizontal girts of claim 11, further comprising:

an eave girt insulation block includes a sloped bottom surface and a top surface, a thickness of said eave girt insulation block is measured from said bottom surface to said top surface, wherein said sloped bottom surface is one of: least thick at a side of an inner space and slopes downward toward an outer wall of a building, least thick adjacent the outer wall and slopes downward toward the inner space of the building, and thickest at a point located between the inner space and the outer wall of the building and slopes upward partially toward both the inner space and partially toward the outer wall of the building.

15. The wall insulation system for a building having a plurality of horizontal girts of claim 11 wherein:

at least one said girt insulation block extends substantially an entire length of each outer wall in the building.

16. The wall insulation system for a building having a plurality of horizontal girts of claim 14 wherein:

said girt and eave girt insulation blocks are fabricated from a non-porous material.

17. The wall insulation system for a building having a plurality of horizontal girts of claim 11 wherein:

said slope has an angle of 0-80 degrees relative to a horizontal plane.

18. A wall baffle system for a building having a plurality of conductive horizontal girts comprising:

at least one insulation panel includes a top surface and a bottom surface, said at least one insulation panel is porous, said at least one insulation panel includes one of: a top heat diverting surface formed on said top surface and a bottom heat diverting surface formed on a bottom surface; said heat diverting surface extends substantially a width of the plurality of conductive horizontal girts, said insulation panel is fabricated from a different material than the plurality of horizontal girts, said at least one insulation panel includes a thickness measured from said top surface to said bottom surface, wherein at least one of said top surface and said bottom surface of said at least one insulation panel is one of: least thick at a side of an inner space and slopes downward toward an outer wall of a building, least thick adjacent the outer wall and slopes downward toward the inner space of the building, and a V-shape double slope which extends a width of said at least one insulation panel; wherein said at least one insulation panel is inserted between two adjacent horizontal girts of a building, wherein the two adjacent girts are at least one of: an eave girt, a wall girt, a floor girt and a base girt.

19. The wall baffle system for a building having a plurality of conductive horizontal girts of claim 18, further comprising: a heat deflecting strip is located on one of a top and a bottom of said at least one insulation panel.

20. The wall baffle system for a building having a plurality of conductive horizontal girts of claim 18 wherein: said slope has an angle of 0-80 degrees relative to a horizontal plane; and said V-shape has two sloped surfaces having an angle of 1-80 degrees relative to a horizontal plane.

* * * * *